US009127341B2

(12) United States Patent
Hirano et al.

(10) Patent No.: US 9,127,341 B2
(45) Date of Patent: Sep. 8, 2015

(54) STEEL SHEET FOR CONTAINER HAVING EXCELLENT ORGANIC FILM PERFORMANCE AND PROCESS FOR PRODUCING THE SAME

(75) Inventors: Shigeru Hirano, Tokyo (JP); Akira Tachiki, Tokyo (JP); Hirokazu Yokoya, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 0 days.

(21) Appl. No.: 12/930,900

(22) Filed: Jan. 18, 2011

(65) Prior Publication Data

US 2012/0183753 A1 Jul. 19, 2012

(51) Int. Cl.

| | |
|---|---|
| ***B32B 15/08*** | (2006.01) |
| ***C23C 2/04*** | (2006.01) |
| ***C23C 22/34*** | (2006.01) |
| ***C23C 22/36*** | (2006.01) |
| ***C25D 9/10*** | (2006.01) |
| ***C25D 11/36*** | (2006.01) |
| ***C23C 2/28*** | (2006.01) |
| ***C25D 3/54*** | (2006.01) |
| ***C25D 5/48*** | (2006.01) |
| ***C25D 7/00*** | (2006.01) |

(52) U.S. Cl.

CPC ... *C23C 2/04* (2013.01); *C23C 2/28* (2013.01); *C23C 22/34* (2013.01); *C23C 22/361* (2013.01); *C25D 3/54* (2013.01); *C25D 5/48* (2013.01); *C25D 7/00* (2013.01); *C25D 9/10* (2013.01); *C25D 11/36* (2013.01); *Y10T 428/24942* (2015.01)

(58) Field of Classification Search

None

See application file for complete search history.

(56) References Cited

U.S. PATENT DOCUMENTS

| | | | | |
|---|---|---|---|---|
| 2003/0213533 | A1 * | 11/2003 | Sako et al. | 148/243 |
| 2005/0175798 | A1 * | 8/2005 | Kurokawa et al. | 428/34.1 |
| 2008/0230394 | A1 * | 9/2008 | Inbe et al. | 205/241 |
| 2009/0218228 | A1 * | 9/2009 | Inbe et al. | 205/80 |

FOREIGN PATENT DOCUMENTS

| | | | |
|---|---|---|---|
| EP | 1134305 | * | 9/2001 |
| JP | 60-170532 | | 9/1985 |
| JP | 02-25784 | | 6/1990 |
| JP | 02-263523 | | 10/1990 |
| JP | 03-032835 | | 2/1991 |
| JP | 03-236954 | | 10/1991 |
| JP | 05-111979 | | 5/1993 |
| JP | 05-124648 | | 5/1993 |
| JP | 05-147181 | | 6/1993 |

* cited by examiner

*Primary Examiner* — Mark Ruthkosky
*Assistant Examiner* — Daniel J Schleis
(74) *Attorney, Agent, or Firm* — Kenyon & Kenyon LLP

(57) ABSTRACT

A surface-treated steel sheet for a container, comprising: a steel sheet, and a Zr compound film disposed on the steel sheet, wherein the Zr compound film being formed by a dipping or electrolytic treatment in a solution containing Zr ion, F ion, ammonium ion and nitrate ion; and the coating weight of the Zr compound film is 1 to 100 mg/m$^2$ in terms of the amount of metallic Zr, and 0.1 mg/m$^2$ or less in terms of the F amount. There is provided a steel sheet for container, which has an excellent processability in the can manufacturing, and at the same time, is excellent in drawing and ironing processability, weldability, corrosion resistance, adherence thereof to a coating material and adherence thereof to a film, and a process for producing such a steel sheet for container.

7 Claims, No Drawings

STEEL SHEET FOR CONTAINER HAVING EXCELLENT ORGANIC FILM PERFORMANCE AND PROCESS FOR PRODUCING THE SAME

BACKGROUND OF THE INVENTION

1. Field of the Invention

The present invention relates to a steel sheet for container, which is usable as a raw material for manufacturing cans, and which is in particular excellent in the processability (or workability) in a drawing and ironing procedure, weldability, corrosion resistance, adherence thereof to a coating material, and adherence thereof to a film. The present invention also relates to a process for producing such a steel sheet for container.

2. Related Background Art

Containers made of metals to be used for containing therein beverages or foods can be classified into two-piece cans and three-piece cans. In the manufacture of the two-piece cans represented by DI cans, after the drawing and ironing process for a raw material for the can, a coating material is applied to the inner surface side of the resultant can, and a coating material and printing are applied to the outer surface side of the can. In the manufacture of the three-piece cans, a coating material is applied to the surface of corresponding to the inner surface of the can, printing is applied to the surface corresponding to the outer surface side of the can, and thereafter the barrel portion of the can is subjected to welding.

In either case of the above types of cans, a coating step to be conducted before or after the can manufacturing step is an indispensable step. In the coating step, a solvent-based or water-based coating material is used, and thereafter, a baking step is performed. In this coating step, a waste matter (such as waste solvent) attributable to the coating material is discharged as industrial wastes, and the exhaust gas (mainly comprising carbon dioxide gas) is released into the atmosphere. In recent years, various attempts or approaches to reduce such industrial wastes and exhaust gases are being made. Among these, a technique of laminating a film has been attracting attention as an alternative to the above coating technique, and such a laminating technique has rapidly been spread.

With respect to the two-piece cans, a large number of can manufacturing processes including a step of laminating a film so as to manufacture a can, and a large number of inventions relating to such processes have heretofore been provided and reported. Examples the invention may include: "Process for manufacturing draw-ironed can (Patent Document 1)", "Draw-ironed can (Patent Document 2)", "Process for manufacturing a thin-walled deep-drawn can (Patent Document 3)" and "Coated steel sheet for draw-ironed can (Patent Document 4)".

Further, with respect to the three-piece cans, examples of the such an invention may include "Film-laminated steel band (or strip) for three-piece can and process for producing the same (Patent Document 5)", "Three-piece can having multilayer organic film on outer surface of can (Patent Document 6)", "Steel sheet for three-piece can having striped multilayer organic film (Patent Document 7)" and "Process for producing striped laminated steel sheet for three-piece can (Patent Document 8)".

On the other hand, with respect to the steel sheet to be used as an underlying layer of the laminate film, chromate films which have been subjected to an electrolytic chromate treatment have been used in many cases. The chromate film has a two-layer structure, where a hydrated Cr oxide layer is present on a metal Cr layer. Accordingly, the laminate film (in the case of a film with an adhesive, the adhesive layer) may ensure the adherence to the steel sheet through the medium of the hydrated Cr oxide layer of the chromate film. The details of the mechanism of developing such an adherence have not clearly been reported yet, but it has been supposed that the hydrogen bonding between the hydroxyl group of the hydrated Cr oxide and the functional group such as carbonyl group or ester group of the laminate film is attributable to the above adherence.

RELATED ART DOCUMENTS

Patent Documents

[Patent Document 1] Japanese Patent No. 1,571,783
[Patent Document 2] Japanese Patent No. 1,670,957
[Patent Document 3] JP-A (Japanese Unexamined Patent Publication; KOKAI) No. 2-263523
[Patent Document 4] Japanese Patent No. 1,601,937
[Patent Document 5] JP-A No. 3-236954
[Patent Document 6] JP-A No. 05-124648
[Patent Document 7] JP-A No. 5-111979
[Patent Document 8] JP-A No. 5-147181

SUMMARY OF THE INVENTION

Problems to be Solved by the Invention

The inventions disclosed in the above publications can certainly produce an effect of considerably promoting the preservation of global environment. On the other hand, however, in the beverage container market, the competition in terms of cost and quality is recently being intensified with respect to raw materials therefore such as PET bottles, bottles and papers. Accordingly, with respect to the above steel sheet for manufacturing laminate containers is also required to satisfy the further improved processability in the can manufacturing, particularly, the adherence thereof to a film, the adherence thereof to the film after the processing of the coated steel sheet, the corrosion resistance and the like, while ensuring the excellent adherence and corrosion resistance of the steel sheet in view of the coating applications thereof as the conventional technique.

In addition, in recent years, the restriction on the use of hazardous substances such as lead and cadmium, or the consideration to the working conditions in a manufacturing factory is being called for mainly in European and North American countries. As a result, there has been developed a tendency to demand a film not using a chromate, and at the same time, not impairing the processability in the can manufacturing.

The present invention has been made in view of the above circumstances. An object of the present invention is to provide a steel sheet for container, which has an excellent processability in the can manufacturing, and at the same time, is excellent in drawing and ironing processability, weldability, corrosion resistance, adherence thereof to a coating material and adherence thereof to a film, and to provide a process for producing such a steel sheet for container.

Means for Solving the Problem

As a result of earnest study on the better use of a Zr compound film as a novel film capable of taking the place of the chromate film, the present inventors have found that a Zr compound film or a Zr composition film obtained by combining a phosphoric acid film or a phenol resin with a Zr compound film, forms a very strong covalent bond with a coating or a laminate film, so as to provide not only higher processability of can manufacturing than that of conventional chromate film, but also excellent drawing and ironing processability, weldability, corrosion resistance, adherence to coating material and adherence to film. Based on such a discovery, the present inventors have has accomplished the present invention.

More specifically, the present invention may include the following embodiments.

[1] A surface-treated steel sheet for a container, comprising:

a steel sheet, and a Zr compound film disposed on the steel sheet; the Zr compound film being formed by a dipping or electrolytic treatment in a solution containing Zr ion, F ion, ammonium ion and nitrate ion;

wherein the coating weight of the Zr compound film is 1 to 100 mg/m$^2$ in terms of the amount of metallic Zr, and 0.1 mg/m$^2$ or less in terms of the F amount.

[2] The surface-treated steel sheet for a container according to [1], wherein the solution further contains phosphate ion, and the coating weight of the Zr compound film is further 0.1 to 50 mg/m$^2$ in terms of the P amount.

[3] The surface-treated steel sheet for a container according to [2], wherein the solution further contains a phenol resin, the Zr compound film further contains a phenol resin, and the coating weight of the phenol resin film is 0.1 to 50 mg/m$^2$ in terms of the C amount.

[4] The surface-treated steel sheet for a container according to any one of [1] to [3], wherein the steel sheet is a surface-treated steel sheet having on at least one surface thereof a surface treating layer containing 10 to 1,000 mg/m$^2$ of Ni, or from 100 to 15,000 mg/m$^2$ of Sn.

[5] A process for producing a surface-treated steel sheet for a container, comprising:

forming the Zr compound film in the solution according to [1] to [3], and then performing a washing treatment by a dipping treatment or a spraying treatment for 0.5 seconds or more with warm water at 40° C. or more.

The steel sheet for a laminate container having an excellent processability in can manufacturing, which has been provided according to the present invention, has excellent drawing and ironing processability, weldability, corrosion resistance, adherence thereof to a coating material and adherence thereof to a film.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

Hereinbelow, the steel sheet for containers, having excellent processability in can manufacturing will be described in more detail, while referring to a best mode for carrying out the present invention.

The raw material sheet to be used in the present invention may not be particularly limited, and a steel sheet usually employed as the raw material for container can be used. This raw material sheet may also be not particularly limited in the production process therefor, the material therefor, and the like, and may be produced through steps such as hot rolling, acid pickling, cold rolling, annealing, temper rolling, etc., to be conducted after an usual step of producing a steel billet or steel bloom. A surface treating layer containing one or more of Ni and Sn may be provided to the raw material sheet, and the process for providing the surface treating layer may not be particularly limited. For example, a known technique such as electroplating method, vacuum vapor deposition method and sputtering method may be used, and for the purpose of providing a diffusion layer, a heat treatment may also be combined after the plating treatment. With respect to Ni, even when Fe—Ni alloy plating is performed, the essence of the present invention may not be changed.

In the thus provided surface treating layer containing one or more of Ni and Sn, the coating weight of Ni may preferably be from 10 to 1,000 mg/m$^2$ in terms of metallic Ni, and the coating weight of Sn may preferably be from 100 to 15,000 mg/m$^2$ in terms of metallic Sn.

Sn may exert an excellent processability, weldability and corrosion resistance, and for the purpose of bringing out this effect, the coating weight thereof may preferably be 100 mg/m$^2$ or more in terms of metallic Sn. This metal may preferably be imparted in an amount of 200 mg/m$^2$ or more for the purpose of ensuring a sufficient weldability, and may preferably be in an amount of 1,000 mg/m$^2$ or more for the purpose of ensuring a sufficient processability. With an increase in the coating weight of Sn, the excellent effect of Sn for enhancing the processability and weldability may be increased. However, if this coating weight exceeds 15,000 mg/m$^2$, the effect of enhancing the corrosion resistance may be saturated, and this may be profitably disadvantageous in an economic point of view. For this reason, the coating weight of Sn may preferably be 15,000 mg/m$^2$ or less in terms of metallic Sn. In addition, an Sn alloy layer may be formed by performing a reflow treatment after the Sn plating, and in this case, the corrosion resistance can be further enhanced.

Ni may exert its effect on the adherence to coating material, adherence to film, corrosion resistance and weldability, and in view of this purpose, the coating weight of Ni may preferably be 10 mg/m$^2$ or more, in terms of metallic Ni. With an increase in the coating weight of Ni, the excellent effect of Ni for enhancing the adherence to film, corrosion resistance and weldability may be increased. However, if this coating weight exceeds 1,000 mg/m$^2$, the enhancing effect thereof may be saturated, and this may be profitably disadvantageous in an economic point of view. For this reason, the coating weight of Ni may preferably be 10 mg/m$^2$ or more, and may preferably be 1,000 mg/m$^2$ or less, in terms of metallic Ni.

Herein, the amount of metallic Ni and the amount of metallic Sn in the above surface treating layer can be measured, for example, by means of a fluorescent X-ray method. In this case, the calibration curve relating to the amount of metallic Ni may be determined in advance by using samples of Ni coating weight, each of which has a known amount of metallic Ni, and based on the resultant calibration curve, the amount of metallic Ni may be relatively determined. Also in the case of the amount of metallic Sn, in a similar manner, a calibration curve relating to the amount of metallic Sn may be determined in advance by using samples of Sn coating weight, each of which has a known amount of metallic Sn, and based on the resultant calibration curve, the amount of metallic Sn may be relatively determined.

On the surface treating layer containing one or more of Ni and Sn, a Zr compound film, or a composite film of a Zr compound and a phenol resin, which is an essence of the present invention, may be provided. Examples of the process for providing such a film may include: a method of dipping the steel sheet in an acidic solution containing Zr ion, phosphate ion, F ion and low-molecular phenol resin, dissolved therein; and a method using a cathodic electrolytic treatment. However, in the dipping treatment, the underlying layer may be etched to thereby form various films, and as a result, the coating is liable to become non-uniform, or a long treatment time may be required, and therefore, this treatment may sometimes be relatively disadvantageous in view of industrial production. On the other hand, in the cathodic electrolytic treatment, a uniform film can be obtained in combination with a coating acceleration effect due to an increase in pH, and with a surface cleaning effect due to forcible charge transfer and hydrogen production in the interface with the steel sheet. Further, in this cathodic electrolytic treatment, nitrate ion and ammonium ion may be present together in the treatment solution, whereby a short treatment time of approximately from several seconds to several tens of seconds can be realized, and the deposition of a Zr compound film containing Zr oxide and Zr phosphate excellent in the effect of enhancing the adherence and the corrosion resistance can be accelerated, whereby the process may industrially be very advantageous. Accordingly, for the purpose of providing the Zr film according to the present invention, a cathodic electrolytic treatment may be preferred, and a cathodic electrolytic treatment using a treatment solution wherein nitrate ion and ammonium ion are present together may further be preferred.

The Zr film may provide an excellent characteristic in practical point of view, even when the film is used alone. On the other hand, a phenol resin, when the film thereof is used alone, may produce only a certain effect and may not provide a sufficient performance in practical point of view. However, when a Zr compound and a phenol resin are combined with each other, a higher practical performance may be exerted.

The role of the Zr compound may be to ensure the above corrosion resistance and adherence. It may be considered that the Zr compound may comprise a Zr phosphate, and a Zr hydrated oxide composed of Zr oxide and Zr hydroxide, and these Zr compounds may have excellent corrosion resistance and adherence. Accordingly, when the coating weight of the Zr film is increased, the corrosion resistance and adherence may begin to be increased. When the coating weight thereof becomes 1 mg/m$^2$ or more in terms of the amount of metallic Zr, the corrosion resistance and adherence can be ensured so as to provide a practically usable level thereof causing substantially no problem. Further, with an increase in the amount of the Zr film, the effect thereof for enhancing the corrosion resistance and adherence may be raised. However, if the amount of the Zr film exceeds 100 mg/m$^2$ in terms of the amount of metallic Zr, the Zr film may become too thick, whereby not only the adherence of the Zr film itself may tend to be decreased, but also the electrical resistance is liable to be increased so as to impair the weldability. For this reason, the coating weight of the Zr film may preferably be from 1 to 100 mg/m$^2$ in terms of the amount of metallic Zr.

In addition, when the coating weight of the Zr phosphate is increased, the resultant corrosion resistance and adherence may further be enhanced. However, when the coating weight of the Zr phosphate is 0.1 mg/m$^2$ or more in terms of the amount of P, the effect provided thereby may clearly be recognized. Further, with an increase in the amount of phosphate film, the effect of enhancing the corrosion resistance and adherence may also be increased. However, if the amount of the phosphate film exceeds 50 mg/m$^2$ in terms of the amount of P, the phosphate film may become too thick, whereby not only the adherence of the phosphate film itself may tend to be decreased, but also the electrical resistance is liable to be increased so as to impair the weldability. For this reason, the coating weight of the phosphate film may preferably be from 0.1 to 50 mg/m$^2$ in terms of the amount of P.

The role of the phenol resin may be to ensure the adherence. The phenol resin itself is an organic substance and therefore, may have a very excellent adherence to a coating material or laminate film. Therefore, with an increase in the coating weight of the phenol resin, the adherence provided thereby may begin to be increased, and when the coating weight thereof becomes 0.1 mg/m$^2$ or more in terms of the amount of C, the adherence can be ensured so as to provide a practically usable level thereof causing substantially no problem. Further, with an increase in the amount of the phenol resin, the effect thereof for enhancing the adherence may also be raised. However, if the amount of the phenol resin exceeds 50 mg/m$^2$ in terms of the amount of C, the electrical resistance is liable to be increased so as to impair the weldability. For this reason, the coating weight of the phenol resin may preferably be from 0.1 to 50 mg/m$^2$ in terms of the amount of C.

F (fluorine) may be usually contained in a solution and therefore, F may tend to be incorporated into the film together with the Zr compound. F in the film may not affect the normal adherence (i.e., primary adherence) to the coating material or film, but may sometimes cause a deterioration in the adherence (i.e., secondary adherence), anti-rusting property, or undercutting corrosion resistance at a high-temperature sterilization treatment such as retort treatment. It may be considered that the reason for the above phenomenon is attributable to a phenomenon that F in the film is dissolved into water vapor or corrosive liquid, so as to breaks down the bonding with the organic film, or to cause the corrosion of the underlying steel sheet. If the amount of F in the film exceeds 0.1 mg/m$^2$, the deterioration in these various characteristics may begin to be actually revealed, and therefore, the amount of F may preferably be set to 0.1 mg/m$^2$ or less. In order to set the amount of F to 0.1 mg/m$^2$ or less, for example, it is possible to form a Zr compound film, and thereafter, to perform a washing (or rinsing) treatment by using a spraying treatment or a dipping treatment with warm water. The amount of F can further be decreased by raising the temperature in the treatment, or by increasing the time of the treatment. More specifically, the amount of F in the film may be set to 0.1 mg/m$^2$ or less, by performing a dipping treatment or a spraying treatment for 0.5 seconds or more in warm water at 40° C. or more. If the water temperature is less than 40° C. or the treatment time is less than 0.5 seconds, this may tend to make it difficult to set the amount of F in the film to 0.1 mg/m$^2$ or less, and to bring out the above various characteristics.

Incidentally, the amounts of metallic Zr, P and F contained in the Zr compound film to be used in the present invention can be measured, for example, by a quantitative analytical methods such as fluorescent X-ray analysis. On the other hand, the amount of C contained in the film containing a phenol resin can be determined by measuring the film by means of a TOC (total organic carbon) meter and subtracting the amount of C present in the steel sheet from the thus obtained value of the TOC.

Further, the concentration of ammonium ion in the treatment solution for cathodic electrolytic treatment may preferably be on the order of 100 to 10,000 ppm, and the concentration of nitrate ion may preferably be on the order of 1,000 to 20,000 ppm. The concentration of ammonium ion can appropriately be adjusted according to the production equipment or production speed (or capacity).

Hereinbelow, the present invention will be described in more detail with reference to specific Examples.

Examples

Examples and Comparative Examples of the present invention are described below, and the conditions and results thereof are shown in Table 1.

<Surface Treating Layer on Steel Sheet>

A surface treating layer was provided on a steel sheet having a sheet thickness of 0.17 to 0.23 mm by using the following processing methods (0) to (6):

(Processing Method 0)

A raw material sheet was subjected to cold rolling, and then annealing and temper rolling. The resultant raw material sheet was then subjected to degreasing and acid pickling, to thereby provide a steel sheet.

(Processing Method 1)

A raw material sheet which had been subjected to cold rolling, and then annealing, temper rolling, degreasing and acid pickling, was subjected to Sn plating by using a Ferrostan bath, to thereby provide an Sn-plated steel sheet.

(Processing Method 2)

A raw material sheet which had been subjected to cold rolling, and then annealing, temper rolling, degreasing and acid pickling, was subjected to Ni plating by using a Watt bath, to thereby provide an Ni-plated steel sheet.

(Processing Method 3)

A raw material sheet which had been subjected to cold rolling, was subjected to Ni plating by using a Watt bath, and then the resultant sheet was subjected to annealing so as to form an Ni diffusion layer at the annealing, to thereby provide an Ni-plated steel sheet.

(Processing Method 4)

A raw material sheet which had been subjected to cold rolling, and then annealing, temper rolling, degreasing and acid pickling, was subjected to Sn plating by using a Ferrostan bath so as to provide an Sn-plated steel sheet. Then, the Sn-plated steel sheet was subjected to a reflow treatment, to thereby provide an Sn-plated steel sheet having an Sn alloy layer.

(Processing Method 5)

A raw material sheet, which had been subjected to cold rolling, and then annealing, temper rolling, degreasing and acid pickling, was subjected to Fe—Ni alloy plating by using a sulfuric acid-hydrochloric acid bath, and was subsequently subjected to Sn plating by using a Ferrostan bath, to thereby provide an Ni/Sn-plated steel sheet.

(Processing Method 6)

A raw material sheet which had been subjected to cold rolling, and then annealing, temper rolling, degreasing and acid pickling, was subjected to Sn—Ni alloy plating by using a sulfuric acid-hydrochloric acid bath, to thereby provide an Ni/Sn-plated steel sheet.

<Film Formation>

After the provision of the surface treating layer using the above processing, a Zr compound film or a Zr compound-phenol resin film was formed by using the following processing methods (7) to (12):

(Processing Method 7)

A Zr compound film was formed by subjecting the above steel sheet to dipping and cathodic electrolysis in a treatment solution containing 1,000 ppm of Zr fluoride and 1,000 ppm of ammonium nitrate dissolved therein.

(Processing Method 8)

A Zr compound film was formed by subjecting the above steel sheet to dipping and cathodic electrolysis in a treatment solution containing 1,500 ppm of Zr fluoride, 500 ppm of phosphoric acid and 5,000 ppm of ammonium nitrate dissolved therein.

(Processing Method 9)

A Zr compound-phenol resin film was formed by subjecting the above steel sheet to dipping and cathodic electrolysis in a treatment solution containing 4,000 ppm of Zr fluoride, 300 ppm of phosphoric acid, 700 ppm of phenol resin and 10,000 ppm of ammonium nitrate dissolved therein.

(Processing Method 10)

A Zr compound film was formed by dipping the above steel sheet in a treatment solution containing 8,000 ppm of Zr fluoride and 1,000 ppm of ammonium nitrate dissolved therein.

(Processing Method 11)

A Zr compound film was formed by subjecting the above steel sheet to dipping and cathodic electrolysis in a treatment solution containing 2,000 ppm of Zr fluoride, 500 ppm of phosphoric acid and 10,000 ppm of ammonium nitrate dissolved therein.

(Processing Method 12)

A Zr compound-phenol resin film was formed by subjecting the above steel sheet to dipping and cathodic electrolysis in a treatment solution containing 1,500 ppm of Zr fluoride, 400 ppm of phosphoric acid, 500 ppm of phenol resin and 5,000 ppm of ammonium nitrate dissolved therein.

<Water Washing (or Rinsing) Treatment>

After the formation of the Zr compound film using the above processing, the amount of F in the film was controlled by subjecting the Zr compound film to a water washing treatment using the following processing methods (13) and (14)

(Processing Method 13)

The steel sheet was dipped in warm water at 40° C. or higher.

(Processing Method 14)

The steel sheet was dipped in water at normal temperature of about 15° C.

In this Example, the amounts of metallic Ni and metallic Sn in the surface treating layer were determined by using a fluorescent X-ray method and then the above value were specified by using a calibration curve. In addition, the amounts of metallic Zr, P and F contained in the Zr compound film were measured by a quantitative analysis method such as fluorescent X-ray analysis. In addition, the amount of C contained in the phenol resin-containing film was determined by measuring the film by means of a TOC (total organic carbon) meter and subtracting the amount of C present in the steel sheet, from the thus obtained value.

<Performance Evaluation>

The test materials (i.e., materials to be tested) which had been subjected to the above processing, was then subjected to performance evaluation on the following items (A) to (F).

Thereafter, performance evaluation was performed on the following items (A) to (G).

(A) Processability

A 20 μm-thick PET film was laminated at 200° C. on both surfaces of the test material, and then the resultant laminate was subjected to a stepwise can manufacturing procedure including a drawing process and an ironing process. The resultant product was subjected to observation on scratching, lifting and peeling (or separation) of the film, to thereby determine the percentage of areas relating to each of scratching, lifting and peeling areas. The thus obtained percentages of scratching, lifting and peeling areas were classified into the following four grades, to thereby evaluate the processability of each of the test materials.

AA: Scratching, lifting and peeling of the film were not observed at all;

A: the area percentage of scratching, lifting and peeling of the film was more than 0% and not more than 0.5%;

B: the area percentage of scratching, lifting and peeling of the film was more than 0.5 and not more than 15%; and C: the area percentage of scratching, lifting and peeling of the film was more than 15%, or the film was broken (or ruptured) so as to make the processing of the test material impossible).

(B) Weldability

The test material was welded by using a wire seam welding machine under the conditions of a welding wire speed of 80 m/min by varying the current, and the breadth of the proper current range between the minimum current value at which a sufficient weld strength to be obtained, and the maximum current value at which weld defect such as dust and weld sputter begin to become noticeable. Based on the overall judgment of the above item, the above results were classified into the following four grades, to thereby evaluate the weldability of each of the test materials.

AA: the proper current range on the secondary side was 1,500 A or more;

A: the proper current range on the secondary side was not less than 800 A and less than 1,500 A;

B: the proper current range on the secondary side was not less than 100 A and less than 800 A; and C: the proper current range on the secondary side was less than 100 A).

(C) Adherence to Film

A 20 μm-thick PET film was laminated at 200° C. on both surfaces of the test material, and then the resultant laminate was subjected to a drawing process and an ironing process, to thereby provide a can body. The can body was then subjected to a retort treatment at 125° C. for 30 minutes. The resultant product was subjected to observation on the state of peeling of the film, to thereby determine the percentage of areas relating to the peeling areas. The thus obtained percentages of peeling areas were classified into the following four grades, to thereby evaluate the film adherence of each of the test materials.

AA: the percentage of peeling area was 0%;

A: the percentage of peeling area was more than 0% and not more than 2%;

B: the percentage of peeling area was more than 2% and not more than 10%; and

C: the percentage of peeling area was more than 10%).

(D) Primary Adherence to Coating Material

An epoxy-phenol resin was applied onto the test material and baked at 200° C. for 30 minute, and the resultant coating was incised at intervals of 1 mm to provide a grid pattern so that the depth of the resultant incision reached the underlying steel. Then, the incised test material was subjected to peeling test by using a tape. Thereafter, the resultant product was subjected to observation on the state of peeling of the film, to thereby determine the percentage of areas relating to the peeling areas. The thus obtained percentages of peeling areas were classified into the following four grades, to thereby evaluate the primary coating material adherence of each of the test materials.

AA: the percentage of peeling area was 0%;

A: the percentage of peeling area was more than 0% and not more than 5%;

B: the percentage of peeling area was more than 5% and not more than 30%; and

C: the percentage of peeling area was more than 30%.

(E) Secondary Adherence to Coating Material

An epoxy-phenol resin was coated on the test material and baked at 200° C. for 30 minute, and the resultant coating was incised at intervals of 1 mm to provide a grid pattern so that the depth of the resultant incision reached the underlying steel. Then, the incised test material was subjected to a retort treatment at 125° C. for 30 minute and dried, and the resultant test material was subjected to peeling test by using a tape. Thereafter, the resultant product was subjected to observation on the state of peeling of the film, to thereby determine the percentage of areas relating to the peeling areas. The thus obtained percentages of peeling areas were classified into the following four grades, to thereby evaluate the secondary coating material adherence of each of the test materials.

AA: the percentage of peeling area was 0%;

A: the percentage of peeling area was more than 0% and not more than 5%;

B: the percentage of peeling area was more than 5 and not more than 30%; and

C: the percentage of peeling area was more than 30%).

(F) Resistance to Corrosion of Material Disposed Under Film

An epoxy-phenol resin was applied onto the test material and baked at 200° C. for 30 minute, the coating was subjected to cross-cut incision so that the depth of the resultant incision reached the underlying steel. Then, the incised test material was subjected to dipping in a test solution comprising a mixed solution of 1.5% citric acid-1.5% common salt at 45° C. for 72 hours. After the washing (or rinsing) and drying of the resultant incised test material, the material was subjected to peeling test by using a tape. Thereafter, the resultant product was subjected to observation on the state of corrosion of the incised test material, to thereby observe the corrosion state of the test material disposed under the cross-cut portion, and the corrosion state of the flat sheet portion. Based on the resultant evaluation of both of the width of corrosion areas relating to the test material disposed under the cross-cut portion, and the percentage of corrosion areas of the flat sheet portion, the thus obtained results were classified into the following four grades, to thereby evaluate the resistance to corrosion of the test material disposed under the film.

AA: the width of corrosion areas relating to the test material disposed under the cross-cut portion was less than 0.2 mm, and the percentage of corrosion area in the flat sheet portion was 0%;

A: the width of corrosion areas relating to the test material disposed under the cross-cut portion was 0.2 mm to less than 0.3 mm, and the percentage of corrosion area in the flat sheet portion was from more than 0 to 1%;

B: the width of corrosion areas relating to the test material disposed under the cross-cut portion was from 0.3 mm to less than 4.5 mm, and the percentage of corrosion area in the flat sheet portion was from more than 1% to 5%; and C: the width of corrosion areas relating to the test material disposed under the cross-cut portion was more than 0.45 mm, or the percentage of corrosion area in the flat sheet portion was more than 5%).

(G) Anti-Rusting Property after Retorting

The test material was subjected to a retort treatment at 125° C. for 30 minutes, and the resultant test material was subjected to observation on the state of rusting of the test material, to thereby determine the percentage of rusting area of the test material. The thus obtained percentages of rusting areas were classified into the following four grades, to thereby evaluate the anti-rusting property after retorting.

AA: the percentage of rusting area was 0%;

A: the percentage of rusting area was from more than 0% to 1%;

B: the percentage of rusting area was from more than 1% to 5%; and

C: the percentage of rusting area was more than 5%).

TABLE 1

| | | Surface Treating Layer | | | Zr, Phosphoric Acid, Phenol Resin Film | | | | | |
|---|---|---|---|---|---|---|---|---|---|---|
| | No. | Processing Method | Amount of Sn ($mg/m^2$) | Amount of Ni ($mg/m^2$) | Processing Method for Zr Film Formation | Processing Method for Water Washing | Coating Weight of Zr ($mg/m^2$) | Coating Weight of F ($mg/m^2$) | Coating Weight of P ($mg/m^2$) | Coating Weight of C ($mg/m^2$) |
| Example | 1 | 0 | — | — | 7 | 13 | 54 | 0.04 | — | — |
| | 2 | 0 | — | — | 9 | 13 | 98 | 0.03 | 48 | 48 |
| | 3 | 1 | 2800 | — | 9 | 13 | 2 | 0.01 or less | 0.3 | 8 |
| | 4 | 1 | 8000 | 12 | 10 | 13 | 8 | 0.01 or less | — | — |
| | 5 | 2 | — | 640 | 7 | 13 | 8 | 0.01 or less | — | — |
| | 6 | 2 | — | 980 | 8 | 13 | 24 | 0.01 or less | 28 | — |
| | 7 | 3 | — | 450 | 9 | 13 | 15 | 0.09 | 24 | 32 |
| | 8 | 3 | — | 950 | 10 | 13 | 45 | 0.01 or less | — | — |
| | 9 | 4 | 13500 | — | 8 | 13 | 6 | 0.01 or less | 2 | — |
| | 10 | 4 | 7800 | 24 | 9 | 13 | 4 | 0.01 or less | 0.2 | 14 |
| | 11 | 5 | 1150 | 15 | 9 | 13 | 12 | 0.01 or less | 3 | 0.2 |
| | 12 | 5 | 750 | 80 | 7 | 13 | 24 | 0.01 or less | — | — |
| | 13 | 6 | 450 | 290 | 8 | 13 | 22 | 0.01 or less | 11 | — |
| | 14 | 6 | 950 | 120 | 9 | 13 | 4 | 0.01 or less | 1 | 2 |
| | 15 | 3 | — | 970 | 10 | 13 | 24 | 0.02 | — | — |
| | 16 | 0 | — | — | 11 | 13 | 80 | 0.018 | 4 | — |
| | 17 | 1 | 188 | — | 12 | 13 | 12 | 0.01 or less | 18 | 15 |
| Comparative Example | 1 | 2 | — | 640 | 12 | 13 | 28 | 0.2 | 78 | 75 |
| | 2 | 0 | — | — | 7 | 14 | 0.8 | 0.3 | — | — |
| | 3 | 1 | 71 | — | 9 | 14 | 120 | 0.12 | 88 | 14 |
| | 4 | 2 | — | 8 | 9 | 14 | 0.5 | 0.05 | 0.07 | 0.07 |

| | | Evaluation | | | | | | |
|---|---|---|---|---|---|---|---|---|
| | | | | Adherence | Adherence to coating material | | Underfilm | Anti-Rusting |
| | No. | Processability | Weldability | to film | primary | secondary | Corrosion | Property |
| Example | 1 | AA | A | A | A | A | A | A |
| | 2 | AA | A | AA-A | AA-A | A | A | A |
| | 3 | AA | AA | AA | AA | AA | AA | A-AA |
| | 4 | AA | AA | AA | AA | AA | AA | AA |
| | 5 | AA | AA | AA | AA | AA | AA | A-AA |
| | 6 | AA | AA | AA | AA | AA | AA | A-AA |
| | 7 | AA | AA | AA | AA | AA | AA | A-AA |
| | 8 | AA | AA | AA | AA | AA | AA | AA |
| | 9 | AA | AA | AA | AA | AA | AA | A-AA |
| | 10 | AA | AA | AA | AA | AA | AA | A-AA |
| | 11 | AA | AA | AA | AA | AA | AA | A-AA |
| | 12 | AA | AA | AA | AA | AA | AA | A-AA |
| | 13 | AA | AA | AA | AA | AA | AA | A-AA |
| | 14 | AA | AA | AA | AA | AA | AA | A-AA |
| | 15 | AA | AA | AA | AA | A | AA | AA |
| | 16 | AA | A | AA-A | AA-A | A | A | A |
| | 17 | AA | AA | A | AA-A | A | AA | A |
| Comparative Example | 1 | AA | B | B | B | B | B | B |
| | 2 | A-B | A | C | C | C | C | C |
| | 3 | A | B-C | B-C | B-C | B-C | C | A |
| | 4 | B | C | C | C | C | C | C |

It is seen that in all of Examples 1 to 17 within the scope of the present invention, the processability, weldability, adherence to film, primary adherence to coating material, secondary adherence to coating material, corrosion of underfilm portion and anti-rusting property are excellent. In Comparative Examples 1 to 5 where some one of the requirements of the present invention is not satisfied, at least a portion of characteristics of processability, weldability, adherence to film, primary adherence to coating material, secondary adherence to coating material, corrosion of underfilm portion and anti-rusting property is inferior.

While the invention has been described with reference to preferred embodiments thereof, the invention is, needless to say, not limited to these examples. Various changes and modifications as will be obvious to one skilled in the art can made therein within the scope of claims, and it should naturally be understood that these changes and modifications also belong to the technical scope of the invention.

What is claimed is:

1. A surface-treated steel sheet for a container, comprising:

a steel sheet, and a Zr compound film disposed on the steel sheet;

the Zr compound film being formed by a dipping or electrolytic treatment in a solution containing Zr ion, F ion, ammonium ion and nitrate ion;

wherein the coating weight of the Zr compound film is 1 to 100 $mg/m^2$ in terms of the amount of metallic Zr, and 0.1 $mg/m^2$ or less in terms of the F amount; and wherein the solution further contains a phenol resin, the Zr compound film further contains a phenol resin, and the coating weight of the phenol resin film is 8 to 50 $mg/m^2$ in terms of an amount of C.

2. The surface-treated steel sheet for a container according to claim 1, wherein the solution further contains phosphate ion, and the coating weight of the Zr compound film is further 0.1 to 50 $mg/m^2$ in terms of the P amount.

3. The surface-treated steel sheet for a container according to any one of claim 1 or 2, wherein the steel sheet is a surface-treated steel sheet having on at least one surface thereof a surface treating layer containing 10 to 1,000 $mg/m^2$ of Ni, or from 100 to 15,000 $mg/m^2$ of Sn.

4. The surface-treated steel sheet for a container according to claim 1, wherein the coating weight of the Zr compound film is 0.09 $mg/m^2$ or less in terms of the F amount.

5. The surface-treated steel sheet for a container according to claim 1, wherein the coating weight of the Zr compound film is 0.04 $mg/m^2$ or less in terms of the F amount.

6. The surface-treated steel sheet for a container according to claim 1, wherein the coating weight of the Zr compound film is 0.02 $mg/m^2$ or less in terms of the F amount.

7. The surface-treated steel sheet for a container according to claim 1, wherein the coating weight of the Zr compound film is 0.01 $mg/m^2$ or less in terms of the F amount.

* * * * *